US006303019B1

(12) United States Patent
Siskin et al.

(10) Patent No.: US 6,303,019 B1
(45) Date of Patent: Oct. 16, 2001

(54) TREATMENT OF REFINERY FEEDSTREAMS TO REMOVE PEROXIDES AND PREVENT SUBSEQUENT REFINERY FOULING USING AN ELECTROCHEMICAL REDUCTION METHOD (LAW890)

(75) Inventors: Michael Siskin, Randolph, NJ (US); Mark A. Greaney, Upper Black Eddy, PA (US); Glen E. Phillips, Branchville, NJ (US)

(73) Assignee: Exxon Research and Engineering Company, Annandale, NJ (US)

( * ) Notice: Subject to any disclaimer, the term of this patent is extended or adjusted under 35 U.S.C. 154(b) by 0 days.

(21) Appl. No.: 09/551,774

(22) Filed: Apr. 18, 2000

(51) Int. Cl.[7] ..... C10G 32/00; C10G 75/04

(52) U.S. Cl. ..... 208/48 AA; 208/48 R; 205/696; 585/834

(58) Field of Search ..... 208/48 AA, 48 R, 208/259, 288, 298; 585/834; 205/696

(56) References Cited

U.S. PATENT DOCUMENTS

| | | | | |
|---|---|---|---|---|
| 4,654,450 | * | 3/1987 | Miller | 585/5 |
| 5,529,684 | * | 6/1996 | Greaney et al. | 208/48 AA |
| 5,817,228 | * | 10/1998 | Greaney et al. | 208/251 R |
| 5,879,529 | * | 3/1999 | Greaney et al. | 205/696 |
| 5,965,008 | * | 10/1999 | Greaney et al. | 205/696 |

* cited by examiner

*Primary Examiner*—Bekir L. Yildirim
(74) *Attorney, Agent, or Firm*—Ronald D. Hantman

(57) ABSTRACT

The present invention is a process to reduce the fouling of equipment for processing petroleum feedstreams. The steps of the process include mixing the feedstream with an aqueous electrolyte forming an oil-in-water dispersion, passing the dispersion through an electrochemical cell, passing a low voltage current through the dispersion, and separating the phases of the dispersion. The oil phase can then be further processed with minimum fouling of the equipment. The water phase is recycled for dispersing fresh petroleum.

10 Claims, 1 Drawing Sheet

Reduction Potentials of Multi-ring Aromatics and Heterocycles

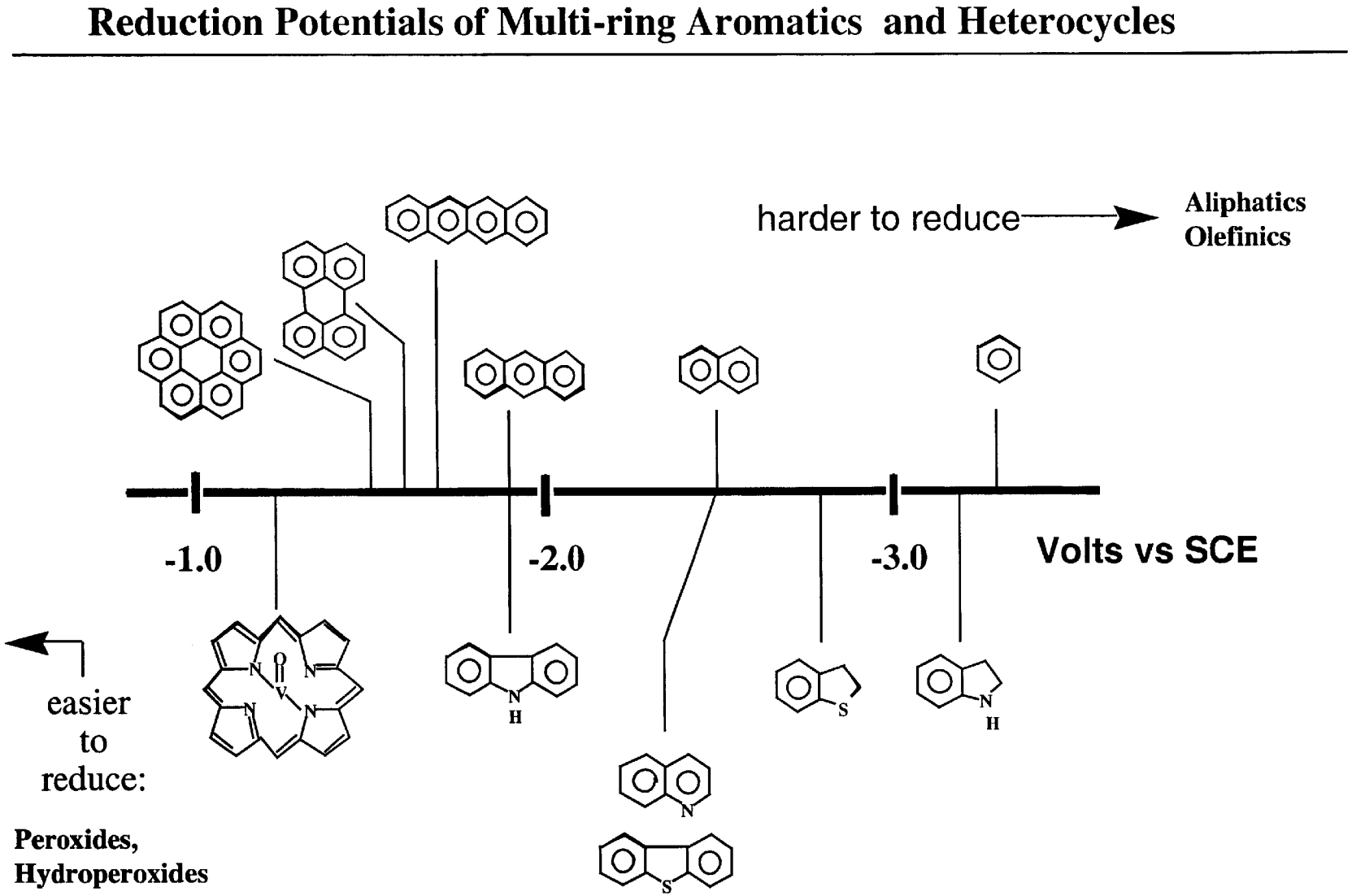
Reduction Potentials of Multi-ring Aromatics and Heterocycles
Aliphatics
Olefinics
harder to reduce
Volts vs SCE
-3.0
-2.0
-1.0
easier
to
reduce:
Peroxides,
Hydroperoxides

TREATMENT OF REFINERY FEEDSTREAMS TO REMOVE PEROXIDES AND PREVENT SUBSEQUENT REFINERY FOULING USING AN ELECTROCHEMICAL REDUCTION METHOD (LAW890)

BACKGROUND OF THE PRESENT INVENTION

The present invention relates to a process to reduce the fouling of equipment for processing petroleum feedstreams. In particular, the fouling is due to the presence of peroxides and hydroperoxides in the petroleum feedstream.

All crude oils contain wppm levels of peroxides and hydroperoxides that were formed by exposure of some crude components, e.g., olefins, conjugated dienes, hydrocarbons containing tertiary hydrogens, pyrroles and indoles, etc. to oxygen in the air. Oxygen, a biradical at room temperature, reacts with these components in minutes (conjugated dienes), to hours (olefins) to weeks (tertiary hydrogens). The presence of even sub-ppm levels of peroxides will lead to fouling of fractionators, heat exchangers, furnaces, etc., and other refinery equipment upon heating. Reaction of peroxides on heating (~100–200° C.) initiates molecular weight growth chemical reactions, such as oligomerizations, polymerizations in pure component feeds, inter- and intramolecular alkylation reactions, etc. For example, a peroxide formed from a conjugated diene can react with other conjugated dienes, with pyrroles, indoles, carbazoles, most phenols, naphthols, thiophenols, naphthalene thiols, etc. An indole peroxide can react with another indole, a conjugated diene, etc., along the path to molecular weight growth reactions. When a feed containing a peroxide is mixed with another feed containing, e.g., conjugated dienes, the molecular weight growth reaction can continue. When the level of molecular weight growth exceeds the solubility of the growth products in solution they precipitate out on metal and other surfaces and foul the surfaces forming coke (thermal coking). The oligomerization and polymerization reactions are chain reactions. So, one molecule of a peroxide can react with hundreds of molecules of olefins or conjugated dienes (of same or varying structure). Oligomerization vs alkylation reactions will depend on the relative concentrations of species in a feed (e.g., of conjugated dienes vs. aromatics, especially $2^+$ ring aromatics, and phenols, thiophenols, etc.). When there are no peroxides in the feed, no chain reaction initiators, most of these molecular weight growth reactions will be inhibited.

SUMMARY OF THE INVENTION

The present invention is a process to reduce the fouling of equipment for processing petroleum feedstreams. The steps of the process include mixing the feedstream with an aqueous electrolyte forming an oil-in-water dispersion, passing the dispersion through an electrochemical cell, passing a low voltage current through the dispersion, and separating the phases of the dispersion. The oil phase can then be further processed with minimum fouling of the equipment. The water phase is recycled for dispersing fresh petroleum.

BRIEF DESCRIPTION OF THE DRAWING

The FIGURE shows the reduction potentials of multi-ring aromatics and heterocycles.

DESCRIPTION OF THE PREFERRED EMBODIMENT

The present invention is a process to reduce fouling of equipment used for processing petroleum feeds. The fouling is due to the presence of peroxides and hydroperoxides and their subsequent reactions.

The process includes the following steps: the peroxide-containing petroleum stream is intimately mixed with an aqueous electrolyte producing an oil-in-water dispersion. This dispersion is then passed through an electrochemical cell that is operated to reduce the peroxides. Upon exiting the electrochemical cell, the dispersion is allowed to phase separate. The peroxide-free petroleum stream continues on in the normal refinery. The aqueous electrolyte is then recycled for dispersing more fresh petroleum.

Peroxides are very polar species and have half-wave reduction potentials well below those of other types of molecules present in crude oils and refinery feeds. Because of this difference in reduction potentials they can be selectively decomposed at room temperature to prevent initiation of subsequent fouling reactions in refinery equipment. Because there are low wppm levels of these contaminants, electrochemical reduction techniques to destroy them become economical. This can also be accomplished chemically, e.g., by addition of iodide or antioxidants, but these are generally uneconomical and can lead to downstream separation problems. A modified desalter may be used for the electrochemical reduction because here we have an aqueous and a hydrocarbon phase in intimate contact and the unit could be set up as an electrolytic, rather than an electrostatic, cell. Reduction of peroxides and hydroperoxides at this early stage in a refinery will dramatically reduce fouling in all downstream refinery equipment. Additional measures such as feed stripping to remove molecular oxygen in solution can be done to prevent the reformation of additional peroxide materials. Feed blanketing with oxygen free inerts to prevent air ingress and checking of all equipment for air leaks will also insure minimum fouling in the refinery. Occasionally a side stream in a refinery process becomes contaminated with air and this can lead to peroxide formation in the feedstream. Addition of this side stream into a previously oxygen/peroxide free refinery process can cause initiation reactions which can lead to fouling where fouling was not a problem previously. The present invention may also be carried out in a modified coalescer. An example of such a situation is fouling in the preheat exchanger prior to a hydrocracker. Fouling was not a severe problem until use of a 400 B/D LKGO reflux wash from the coker fractionator was initiated to remove ammonium chloride. This LKGO wash is sent to a coalescer drum to water wash/dissolve the extracted ammonium chloride. The water wash in this case uses local river water that is saturated with air/oxygen. The oxygen reacts with the olefins, conjugated dienes, pyrroles, indoles, tertiary hydrogen containing hydrocarbons and the like in the LKGO to form peroxides and hydroperoxides. When the LKGO from the coalescer drum is added back into the feed to the hydrocracker, the peroxides in this small side stream initiate fouling reactions in the preheat exchanger. The coalescer, which contains a two phase aqueous/hydrocarbon system may, with modifications, be a suitable vessel for electrochemical reduction of the undesirable peroxide contaminants, prior to mixing with other feedstreams.

Half-wave reduction potentials for organic peroxides and hydroperoxides show that these species are very easy to reduce (and thereby decompose) relative to other components in a petroleum stream. Therefore, the other components will not be effected by the process as they would be if higher potentials had been used. In one of the more comprehensive references (B. Salvato, et al, Electroanalysis 7, 88 (1995)) over twenty peroxides were analyzed and the half-wave potentials ranged from +0.08 to −1.35 V vs SCE. Only one had a reduction potential more negative than −1.0 V. For example, the reduction potential of benzoyl peroxide, is typical of the type of peroxide commonly encountered in potentially fouling petroleum streams: −0.35 V. For comparison, vanadyl octaethyl porphyrin reduces at −1.35 V vs SCE. Based upon the greater ease of reduction of peroxides and hydroperoxides, this process is very selective. FIG. 1 shows a reduction potential plot which illustrates how much easier these molecules are to reduce relative to other petroleum stream components.

It is preferred to carry out the process under an inert atmosphere. A benefit to the present invention is that the process may be operated under ambient temperature and atmospheric pressure, although higher temperature and pressures also may be used as needed. Its most basic form is carried out in an electrochemical cell, by electrolytic means, i.e., in a non-electrostatic mode, as passage of current through the mixture or oil-in-water dispersion is required (e.g., relatively low voltage/high current). The cell may be either divided or undivided. Such systems include stirred batch or flow through reactors. The foregoing may be purchased commercially or made using technology known in the art. Suitable electrodes known in the art may be used. Included as suitable electrodes are three-dimensional electrodes, such as carbon or metallic foams. The optimal electrode design would depend upon normal electrochemical engineering considerations (see Electrode Processes and Electrochemical Engineering by Fumio Hine (Plenum Press, New York 1985) and could include divided and undivided plate and frame cells, bipolar stacks, fluidized bed electrodes and porous three dimensional electrode designs. The cathodic voltage will vary depending on the peroxides to be removed. The cathodic voltage is in the range +0.5 to −1.5 V versus Saturated Calomel Electrode (SCE), preferably 0 to −1.0 V based on the characteristics of the particular petroleum fraction. While direct current is typically used, electrode perfonnance may be enhanced using alternating current, or other voltage/current waveforms.

The electrolyte in the aqueous electrolysis medium is desirably an electrolyte that dissolves or dissociates in water to produce electrically conducting ions, but that does not undergo redox in the range of applied potentials used. Organic electrolytes include quatemary carbyl- and hydrocarbyl-onium salts, e.g., alkylammonium hydroxides. Inorganic electrolytes include, e.g., NaOH, KOH and sodium phosphates. Mixtures thereof also may be used Suitable onium ions include mono- and bis-phosphonium, sulfonium and ammonium, preferably ammonium ions. Carbyl and hydrocarbyl moieties are preferably alkyl. Quaternary alkyl ammonium ions include tetrabutyl ammonium, and terabutyl ammonium toluene sulfonate. Optionally, additives known in the art to enhance performance of the electrodes or the system may be added such as surfactants, detergents, emulsifying agents and anodic depolarizing agents. Basic electrolytes are most preferred. The concentration of salt in the electrolysis medium should be sufficient to generate an electrically conducting solution in the presence of the petroleum component. Typically a concentration of 1–50 wt. % aqueous phase, preferably 5–25 wt. % is suitable.

Performing controlled potential electrolysis on a non-conductive fluid such as a petroleum stream requires the introduction of a conductive salt. The direct addition of a salt to the petroleum stream is undesirable for several reasons. Once dissolved in oil, these salts are difficult to remove after electrolysis. Incomplete salt removal is unacceptable due to product specifications, negative impact on further catalytic processing, potential corrosivity and equipment fouling. Even salts which are soluble in a low dielectric medium are poorly ionized and therefore high concentrations are required to achieve acceptable conductivities. In addition, such salts are typically very expensive.

A better solution to the low conductivity problem of petroleum is described in this application. Rather than add the electrolyte to the petroleum stream, we disperse the petroleum stream in a conductive aqueous electrolyte. This two phase system of oil dispersed in a continuous water phase provides an adequate electrolysis medium. The continuous aqueous phase provides sufficient conductivity between the cathode and anode to maintain a constant electrode potential. Turbulent flow through the electrochemical cell brings the petroleum droplets into contact with the cathode at which point electrons are transferred from the electrode to species on the droplet surface. Protons are readily extracted from the aqueous phase allowing the following reductive decomposition of peroxides to occur:

$$ROOR+2e^{-}+2H^{+}\rightarrow 2ROH$$

After reaction, the separation of aqueous electrolyte from the treated petroleum stream is straight forward. An uncontaminated petroleum stream is thereby produced and the aqueous electrolyte is simply recycled. Many low cost aqueous electrolyte salts are available.

For ease of separation following electrolysis, oil-in-water dispersions are preferred. However, more stable oil-in-water emulsions could be used. Following electrolytic treatment, the stable emulsion could be broken by the addition of heat or de-emulsifying agents.

EXAMPLE 1

Electrolytic Peroxide Decomposition

Twenty milliliters of a solution of benzoyl peroxide in tetradecane was added to a coulometry cell (Princeton Applied Research Model #377A) along with twenty milliliters of a 40 wt. % aqueous terabutylammonium hydroxide solution (TBAOH). The electrochemical cell consisted of a mercury pool cathode, a platinum wire anode and a saturated calomel reference electrode (SCE) linked via a Luggin capillary bridge tube. The peroxide in tetradecane phase was dispersed in the aqueous electrolyte phase by a glass paddle stirrer supplied with the cell. After nitrogen purging, the dispersion was reduced at −1.2 V versus SCE for one hour at room temperature. Upon completion, the liquid was removed from the cell, allowed to separate and then the organic layer was removed for analysis. (Galbraith Laboratories, Inc., Knoxville, Tenn.). The initial solution had a peroxide value of 10.67 mg/kg and the electrolytically treated product had a peroxide value below the detection limit (<2 mg/kg).

COMPARATIVE EXAMPLE 1

Non-Electrolytic Peroxide Decomposition at 0.0 V vs SCE

The same procedure as described in Example 1 was repeated, but with a reduction potential set at 0.0 V. Benzoyl peroxide should not be reduced/decomposed at this potential. After this treatment, the peroxide value dropped from 10.67 to 7.75 mg/kg. The small loss of peroxide by presumably non-electrolytic processes is likely due to some solubililation of the peroxide in the aqueous phase by TBAOH.

EXAMPLE 2

Electrolytic Peroxide Decomposition in a Light Coker Gas Oil

The same basic procedure as described in Example 1 was repeated except that the tetradecane was replaced with a real refinery stream, a light coker gas oil. Though this feed would normally contain low levels of peroxides, it was "spiked" with benzoyl peroxide in order to increase the accuracy of the peroxide value analysis. The dispersion was reduced at −1.0 V vs SCE. The initial "spiked" coker gas oil had a peroxide value of 30.4 mg/kg and the electrolytically treated produce had a peroxide value of 7.9 mg/kg.

What is claimed is:

1. A process to reduce the fouling of equipment for processing petroleum feedstreams comprising:

(a) mixing said petroleum feedstream with an aqueous electrolyte forming an oil-in-water dispersion;

(b) passing said dispersion through an electrochemical cell having a sufficient current at an appropriate voltage to reduce the peroxide content; and (c) separting said phases of said dispersion.

2. The process of claim 1 further comprising the step of processing said oil phase.

3. The process of claim 1 further comprising the step of recycling said aqueous electrolyte phase.

4. The process of claim 1 wherein said electrochemical operates with a reduction potential of between +0.5 to −1.5 vs SCE.

5. The process of claim 1 wherein said electrolyte includes a quaternary carbyl-onium salt or a quaternary hydrocarbyl-onium salt.

6. The process of claim 5 wherein said salts are alkyl compounds.

7. The process of claim 1 wherein said electrolyte includes sodium hydroxide, potassium hydroxide, or sodium phosphate or mixtures thereof.

8. The process of claim 5 wherein said onium includes mono- and bis-phosphonium, sulfonium, and ammonium.

9. The process of claim 8 wherein said onium is ammonium.

10. The process of claim 9 wherein said electrolyte includes tetrabutyl ammonium and tetrabutyl ammonium toluene sulfonate.

* * * * *